United States Patent [19]

Herr

[11] 4,241,647

[45] Dec. 30, 1980

[54] AIR DAMPER VALVE

[75] Inventor: Leroy E. Herr, Buffalo Grove, Ill.

[73] Assignee: Dayco Corporation, Dayton, Ohio

[21] Appl. No.: 67,853

[22] Filed: Aug. 20, 1979

[51] Int. Cl.[3] ..... F24F 13/14

[52] U.S. Cl. ..... 98/121 A; 49/78; 98/110; 137/601

[58] Field of Search ..... 98/110, 121 A; 137/601; 49/75, 76, 77, 78, 92, 74

[56] References Cited

FOREIGN PATENT DOCUMENTS

| | | | |
|---|---|---|---|
| 625207 | 2/1936 | Fed. Rep. of Germany | 98/110 |
| 2342531 | 2/1975 | Fed. Rep. of Germany | 137/601 |
| 2821708 | 11/1978 | Fed. Rep. of Germany | 137/601 |
| 706388 | 3/1954 | United Kingdom | 98/110 |
| 983191 | 2/1965 | United Kingdom | 137/601 |

*Primary Examiner*—Albert J. Makay
*Assistant Examiner*—Harold Joyce
*Attorney, Agent, or Firm*—Reuben Wolk; Charles E. Bricker

[57] ABSTRACT

An air damper having a plurality of blades of the opposed blade type is provided wherein such damper provides substantially uniform air flow distribution throughout the flow area of such damper.

19 Claims, 6 Drawing Figures

AIR DAMPER VALVE

BACKGROUND OF THE INVENTION

1. Field of the Invention

This invention relates to valves and in particular to multiple blade air damper valves or air dampers.

2. Prior Art Statement

Multiple blade air dampers are widely used in industry in association with fan systems of all types. Multiple blade air dampers may be of the so-called parallel blade type wherein a plurality of air flow control blades are rotated in the same direction of rotation to control the positions thereof. In addition, such multiple blade air dampers may be of the so-called opposed blade type wherein alternate air flow control blades are rotated in opposite directions to control their positions.

Opposed blade air dampers are employed where it is desired to provide a more even distribution of air flow downstream of the damper. However, opposed blade dampers proposed heretofore do not provide optimum air flow distribution throughout the flow area thereof.

SUMMARY

It is a feature of this invention to provide an opposed blade air damper which provides a substantially uniform air flow distribution throughout the flow area of the damper.

Another feature of this invention is to provide an air damper comprising; a housing structure; a plurality of opposed blades each having rotatable shaft means and flow control plates with the blades having means supporting the shaft means on the housing structure enabling the control plates to be disposed in aligned relation to define a substantially planar shut-off structure for the damper and to regulate air flow therethrough; and wherein the means supporting the shaft means comprises bearings supporting the shaft means of one blade on one side of the planar structure and shaft means of an immediately adjacent blade on the opposite side of the planar structure; a linkage system for operating the shaft means; and an operating device for operating the shaft means and the linkage system. The bearings, blades, and linkage system are constructed and arranged so that upon operation of said operating device the rotational displacement of each blade from any reference position is approximately the same and the air flow distribution throughout the flow area of the damper is substantially uniform.

Another feature of this invention is to provide an air damper of the character mentioned which is simple and of economical construction.

Another feature of this invention is to provide an air damper of the character mentioned wherein the plurality of opposed blades thereof are substantially identical, are of simple construction, and may be used at alternate positions across the flow area of the damper by turning the blades end for end.

Another feature of this invention is to provide an air damper of the character mentioned having simple bearing means supporting the shaft means of each of the blades of the damper.

Another feature of this invention is to provide an air damper of the character mentioned having flow characteristics such that either end thereof may be the inlet without substantial change of the air flow characteristics therethrough.

Another feature of this invention is to provide an air damper of the character mentioned having a simple and unique linkage system and mounting system for the blades.

Another feature of this invention is to provide a damper of the character mentioned wherein the linkage system has a plurality of identical arms operatively connected to shafts of the blades enabling such blades to be operated at substantially uniform velocity either clockwise or counterclockwise during operation thereof.

Another feature of this invention is to provide an improved method of making an air damper of the character mentioned.

Therefore, it is an object of this invention to provide an improved air damper and method of making same having one or more of the novel features as set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
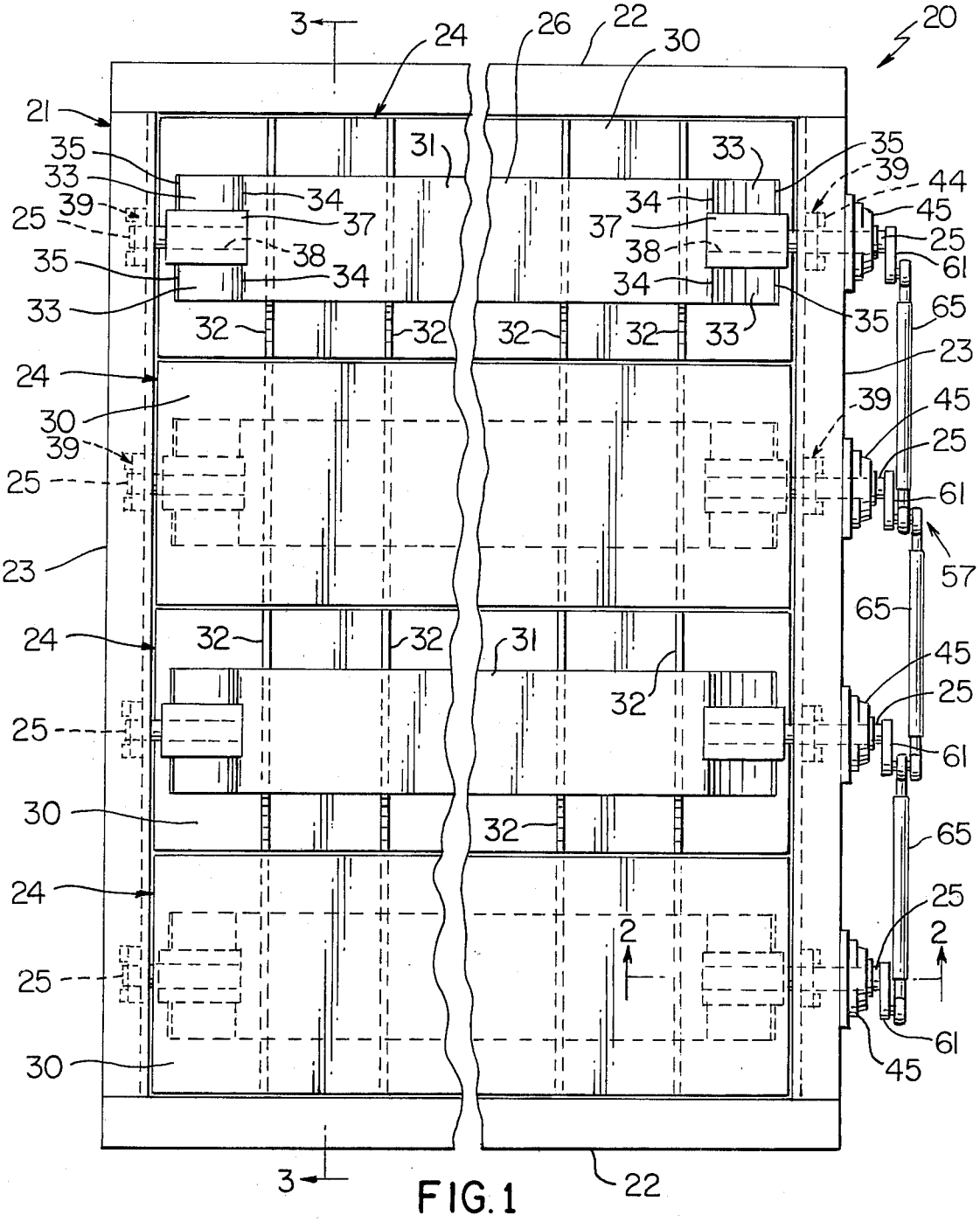
FIG. 1 is a view looking substantially perpendicularly toward the inlet of one exemplary embodiment of a multiple blade air damper of this invention with the blades thereof in a closed position.

Reference is now made to FIG. 1 of the drawings which illustrates one exemplary embodiment of the air damper valve of this invention and as is common in the art such air damper valve will be referred to hereinafter simply as an air damper and designated generally by the reference numeral 20. The air damper 20 is of the opposed blade type and the constructions of the blades, support bearing means for the blades, and linkage system operating same are such that the air flow distribution throughout the flow area of the damper is substantially uniform and in a manner not possible with previously proposed opposed blade louvers or dampers.

The air damper 20 comprises a housing structure which will be designated generally by the reference numeral 21 and such housing structure is of substantially rectangular outline and is defined by a pair of spaced apart horizontally disposed U-shaped channels designated by the same reference numeral 22 and a pair of similar vertically disposed U-shaped channels each designated by the same reference numeral 23. The channels 22 and 23 are suitably fixed together at their junctions to define the corners of the housing structure 21. Any suitable means known in the art such as suitable welds, or the like, may be used to fix the channels 22–23 together.

The air damper 20 comprises a plurality of opposed blades each designated generally by the same reference numeral 24 and each blade 24 has rotatable shaft means defined by a pair of shaft portions or shafts each designated generally by the same reference numeral 25. The shafts 25 are fixed to opposite ends of a main central body 26 of each blade 24, and the shafts for a particular blade are aligned on a common rectilinear path or central longitudinal axis through the blade.

Figure 2:
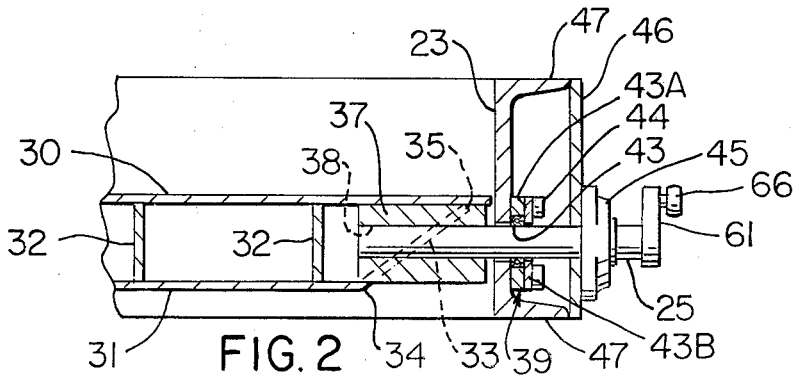
FIG. 2 is a fragmentary view with parts in cross section and parts in elevation taken essentially on the line 2—2 of FIG. 1.

As seen in FIG. 2 of the drawings the main central body 26 of each blade 24 is comprised of a pair of planar plate members 30 and 31 which are held in spaced parallel relation by a plurality of webs 32 of trapezoidal outline extending perpendicularly therebetween. The webs 32 are suitably fixed in position by welds, or the like, fixing their opposite edges to the members 30 and 31; and the member 31 has a support extension 33 which extends at an angle from its terminal end edge 34 to an end edge portion 35 of the member 30. The planar plate member 30 is of comparatively larger area than the member 31 and member 30 will also be referred to as a flow control plate.

The rotatable shaft means of each blade 24 consists of the pair of aligned shafts 25 at opposite ends of the main body 26 of each blade 24. Each shaft 25 is suitably fixed on a block structure 37 which is in turn fixed between the inside surfaces of the planar plate members 30 and 31. The block structure or block 37 has an opening 38 extending therethrough which receives an end portion of an associated shaft 25 therewithin and the associated shaft 25 is fixed to the block structure 37 and hence to the main central body 26 of the blade.

Figure 3:
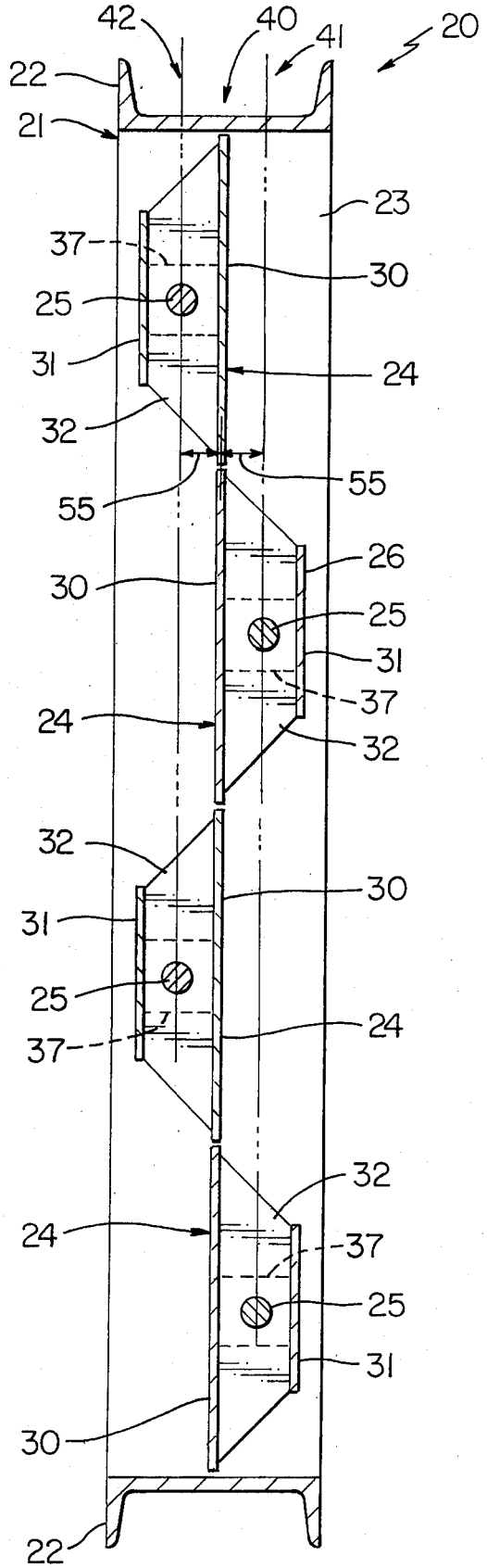
FIG. 3 is a cross-sectional view taken essentially on the line 3—3 of FIG. 1.

The blades 24 have means supporting the shaft means or shafts 25 extending from opposite ends thereof on the housing structure 21 and enabling the flow control plates 30 to be disposed in substantially aligned relation to define a substantially planar shut-off structure 40 for the damper, as shown in FIG. 3, and to regulate air flow therethrough. The means supporting the shaft means of shafts 25 comprises bearing means supporting the shaft 25 of one blade on one side of the planar structure 40 as shown at 41 and the shaft 25 of one immediately adjacent blade on the opposite side of the planar structure 40 as shown at 42.

Figure 4:
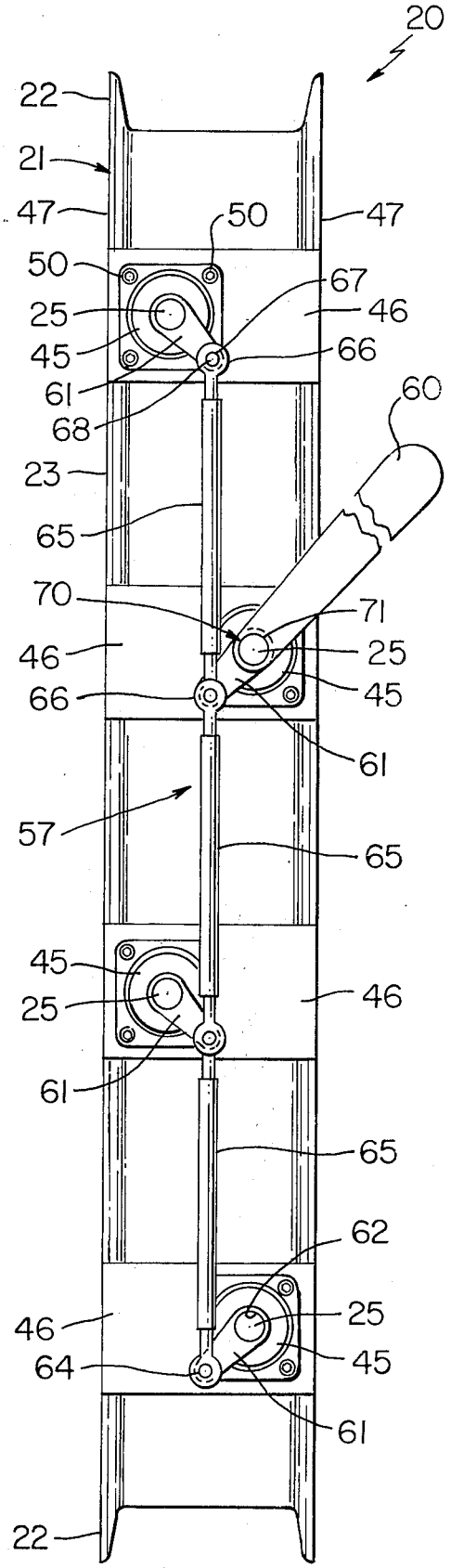
FIG. 4 is a side view of the air damper of FIG. 1.

The support means for each shaft 25 comprises an inner packing arrangement designated generally by the reference numeral 39 and consisting of a packing 43 suitably fixed inside an annual member 43A which is in turn attached by threaded bolts 44 acting through a ring 43B to an associated vertically disposed U-shaped channel 23 of the housing structure 21. The bearing means for each shaft also comprises an outer antifriction bearing assembly 45 which is supported by a plate 46 which is in turn fixed, as by welding, to the outer ends of the parallel legs 47 of an associated U-shaped channel 23. As shown in FIG. 4, a plurality of threaded metal screws 50 are used to fasten each assembly 45 to an associated plate 46. The support means for each shaft 25 thus consists of the inner packing 43 and the outer bearing 45.

The air damper 20 of this disclosure of the invention is a four blade damper whereby two alternate, i.e., alternately disposed, blades have their shafts 25 disposed in a plane upstream of the planar shut-off structure 40 defined by the flow control plates 30 and two alternate blades have their shafts 25 disposed in a plane on the opposite side of, i.e. downstream, of the planar shut-off structure. The plane upstream of the structure 40 is defined by the axes of the shafts 25 and bearing means at 42 and such plane will be designated by dot-dash lines and also designated by the numeral 42. The plane downstream of the structure 40 is defined by the axes of the shafts 25 and bearing means at 41 and such plane will be designated by dot-dash lines and also designated by the numeral 41. With this construction it is seen that the blades 24 are mounted in two sets. The blades 24 of the upstream set are mounted with their shafts 25 in plane 42 and the blades of the downstream set are mounted with their shafts 25 in plane 41. In addition, it will be seen that the planes 42–41 are equidistant by the distance 55 from the plane structure 40.

Figure 6:
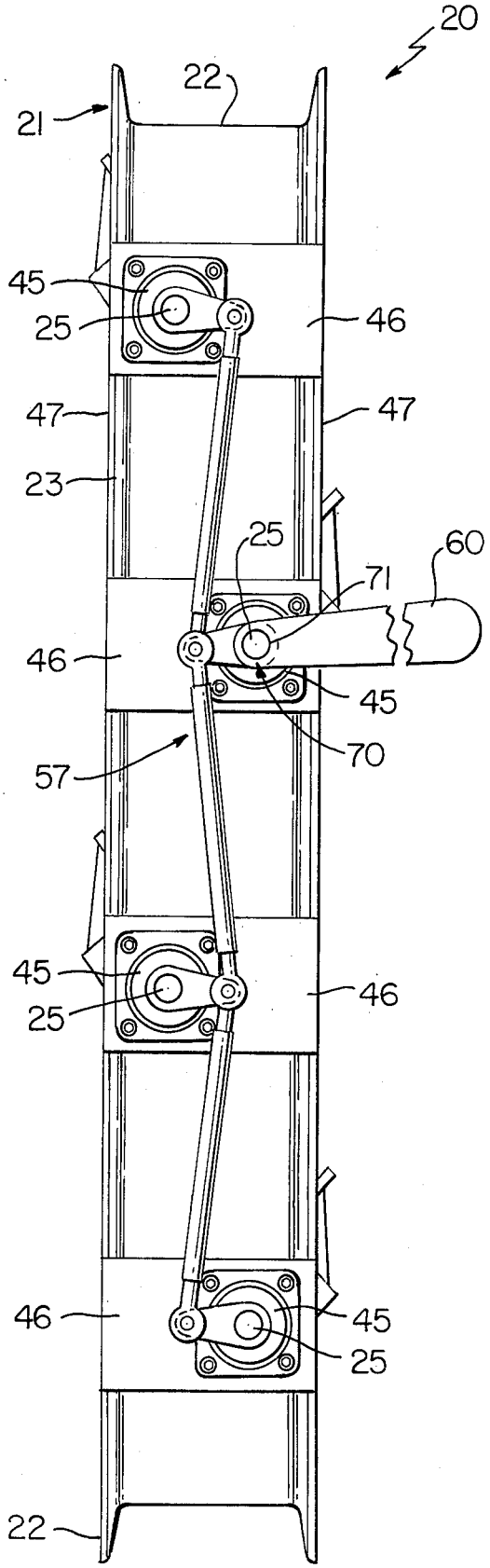
FIG. 6 is a view similar to FIG. 4 showing the linkage system holding the blades in the solid line position of FIG. 5.

The damper 20 also has a linkage system designated generally by the reference numeral 57, see FIGS. 4 and 6 for operating the shaft means and in particular for operating the shafts 25. The damper 20 also has operating means shown as an operating device or lever 60 for operating the shafts 25 and linkage system 57.

The bearing means for the blades 24, blades 24, and linkage system 57 are constructed and arranged so that upon operation of the operating means or lever 60 the rotational displacement of each blade from any reference position is approximately the same and the air distribution throughout the flow area of the damper is substantially uniform. Stated in another manner it will be appreciated that the control of air flow by each blade 24 through the damper is substantially the same.

As seen in FIGS. 4 and 6 the linkage system is of optimum simplicity and basically the linkage system 57 comprises a plurality of arms 61 of equal length and each arm is suitably fixed, as is known in the art, to an associated shaft 25. Each arm 61 has an opening 62 (FIG. 4) in its inner end which receives the outer end of an associated shaft 25 therethrough; and, each arm 61 has an outer end provided with a smaller opening 64 which is provided for a purpose to be subsequently described. The linkage system 57 also includes a plurality of elongate links or members 65 each of which may have an adjustable central portion which may be adjustable by any suitable means known in the art such as by threaded adjustment. The members 65 have enlarged opposite ends 66 which have openings 67 therethrough. Each opening 67 is adapted to be aligned with an associated opening 64 in the terminal outer end of an associated arm 64 and a fastening pin 68 is extended therethrough to fasten each arm 61 to an associated member while allowing pivoting or rotary movement therebetween.

Thus, it is seen that the linkage system 57, in essence, provides positive rotary forces or torques which rotate the shafts 25 on one side of the blades 24, and hence one side of the damper 20, and the main bodies 21 of such blades transmit the rotary forces to the shafts 25 on the opposite side of the blades to provide rotation thereof in a simultaneous manner.

The operating means provided for operating the shafts 25 and linkage system 57 of the exemplary air damper valve is a manually operated lever 60 which is suitably fixed to one of the shafts 25, as shown at 70 in FIGS. 4 and 6. The lever 60 has an opening 71 in the inner end thereof which is adapted to receive an associated shaft 25 therethrough and the lever is then suitably fixed in position by a key (not shown) or the like. Upon rotating the shaft 25 or 70 using the lever 60 the arm 61 fixed to such shaft at 70 is also rotated thereby moving linkage system 57 in a simultaneous manner. It will be appreciated that the operating lever 60 may be fixed to any one of the shafts 25 of any blade 24 to operate the linkage system 57 and all blades.

The operating means is shown herein as an operating lever 60 as being manually operated. However, it is to be understood that the lever 60 may be mechanically operated. Further, any suitable means known in the art may be employed in lieu of lever 60, such as, an electric, pneumatic, or hydraulic motor, or the like.

However, the unique feature of this invention is the provision of the cooperating bearing means, blades 24, and linkage system 57 constructed and arranged so that upon operation of the operating means or lever 60 the rotational displacement of each blade 24 from any reference position is approximately the same. This rotational displacement is approximately the same even though alternate blades are rotated in opposite direction.

Figure 5:
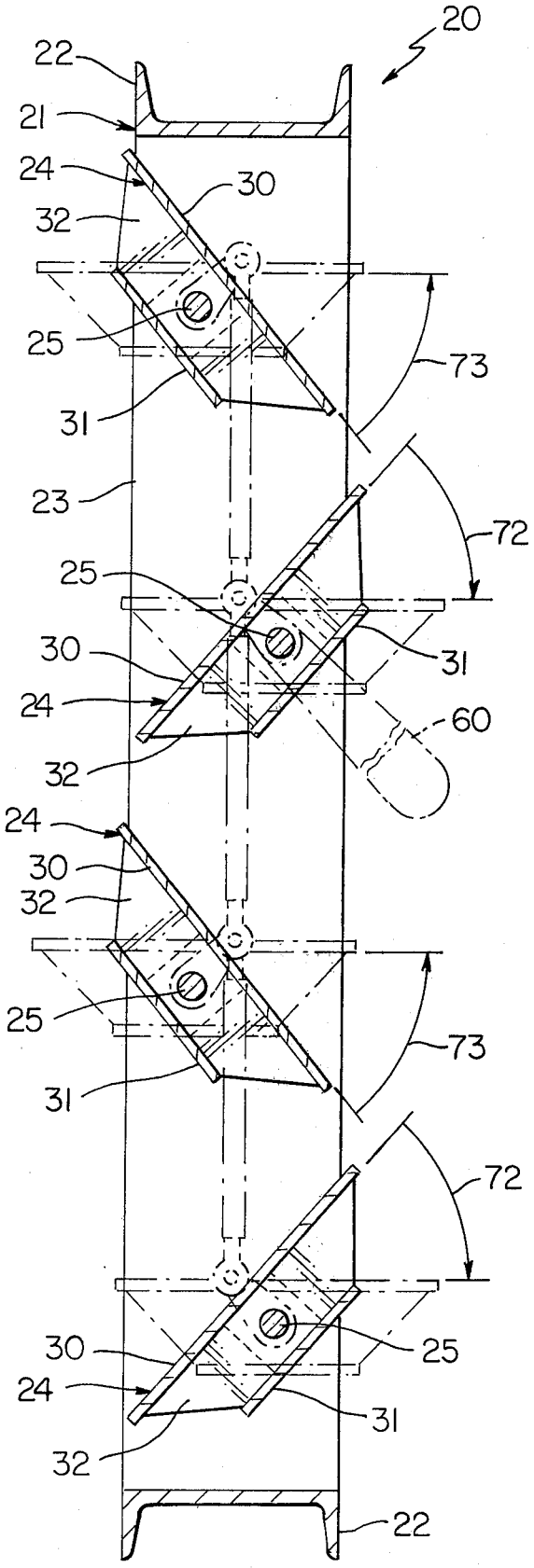
FIG. 5 is a view similar to FIG. 3 showing by solid lines the blades of the air damper in a partially open position and showing by dot-dash lines the blades in a fully open position together with the associated linkage holding such blades in such fully open position.

It will be noted, for example, that upon rotating the lever 60 and the blade 24 associated therewith at 70 in FIG. 5 through the clockwise angular displacement or angle 72 (shown from the solid line position thereof to the dotted line position thereof) the immediately adjacent blade on either side thereof is simultaneously rotated counterclockwise through an angular displacement or increment 73 which is approximately the same magnitude as the magnitude of the angular increment 72. Similarly the lowermost blade 24 of the damper 20 is also rotated clockwise by the linkage 57 through the angular increment or angle 72.

As stated above the rotational displacement of each blade 24 from any reference position is approximately the same. This reference to approximately the same is defined to mean that at any angular position thereof each blade 24 will not vary from an immediately adjacent blade by more than 3 degrees of angular displacement.

Previous opposed blade dampers generally vary by as much as 12 degrees of angular displacement between immediately adjacent blades 24 depending on the particular angular position between the two extremes of the damper being fully open and fully closed. In addition, between these two extremes, different blades of previous opposed blade dampers will be at substantially different angular displacements from blade to blade making it difficult if not impossible to provide substantially uniform air flow distribution throughout the flow area of the damper.

The damper of this invention may be used in numerous applications where air flow dampers are required and such damper may be used and associated with fans or other devices to improve the overall efficiency of an associated air system. The opposed air damper of this invention may be used either upstream or downstream of an associated fan and still provides optimum performance.

The damper 20 of this invention is also insensitive to the manner of installation in a duct system. In particular, such damper may be installed in a duct system so that either end may be the inlet.

Each blade 24 of the damper disclosed herein is shown with shaft means in the form of shafts 25 at opposite ends of its main central body 26. However, it will be appreciated that a one-piece shaft may be provided and extended completely across the full length of the blade and provided with end portions similar to shafts 25. Such a one-piece shaft may be fixed to the main body 26 using any suitable technique known in the art.

The damper 20 of this invention may be used in air systems which require either a small or large area damper. For example, such damper may vary in effective flow area from a few square feet to over 100 square feet.

The damper 20 of this invention may be made of any suitable material and constructed using any fabricating technique known in the art. The damper is usually made of a suitable metal and such metal is preferably compatible with the air system in which it is used and the impurities carried by such air system.

In this disclosure of the invention the shafts 25 associated with the linkage system 57 together with their associated bearing means and supporting structures have been described in detail. However, it is to be understood that the shafts 25 on the opposite side of the damper 20, and hence opposite sides the blades 24, have identical bearing means and associated supported structures and thus will not be described in detail.

While present exemplary embodiments of this invention, and methods of practicing the same, have been illustrated and described, it will be recognized that this invention may be otherwise variously embodied and practiced within the scope of the following claims.

What is claimed is:

1. In an air damper comprising; a housing structure; a plurality of opposed blades each having rotatable shaft means and flow control plates; said blades having means supporting said shaft means on said housing structure enabling said control plates to be disposed in aligned relation to define a substantially planar shut-off structure for said damper and to regulate air flow therethrough; the improvement wherein said means supporting said shaft means comprises bearing means supporting said shaft means of one blade on one side of said planar structure and the shaft means of an immediately adjacent blade on the opposite side of said planar structure; a linkage system for operating said shaft means; and operating means for operating said shaft means and said linkage system; said bearing means, blades, and linkage system being constructed and arranged so that upon operation of said operating means the rotational displacement of each blade from any reference position is approximately the same and the air flow distribution throughout the flow area of said damper is substantially uniform; said linkage system comprising, an arm fixed to each shaft means at the same side of each blade, said arms being of equal length and with said blades disposed in said aligned relation and defining said planar shut-off structure the arm of one blade extends from its shaft means generally in one direction toward said planar shut-off structure and the arm of an immediately adjacent blade extends from its shaft means in a direction roughly opposite from said one direction toward said planar shut-off structure, and a plurality of links connected between said arms, each of said links extending between the terminal outer ends of each pair of immediately adjacent arms.

2. An air damper as set forth in claim 1 in which each of said blades is comprised of a pair of parallel plates each of rectangular outline and wherein one of said plates defines said flow control plate of the blade and the other of the plates has an area smaller than the area of the flow control plate and is disposed in spaced parallel relation therefrom.

3. An air damper as set forth in claim 2 and further comprising a plurality of sheet-like webs having opposite end edges fixed to and holding said plates in said spaced parallel relation.

4. An air damper as set forth in claim 3 in which each of said webs is of substantially trapezoidal outline and wherein the parallel end edge thereof having the longer dimension is fixed to said control plate.

5. An air damper as set forth in claim 2 in which said shaft means comprises a pair of shafts associated with each blade and fixed in rectilinearly aligned relation at opposite ends of the blade.

6. An air damper as set forth in claim 5 and further comprising a support block supporting each shaft, each support block being fixed between its associated plates.

7. An air damper as set forth in claim 6 in which each support block has a cylindrical opening which receives an associated shaft therein, said associated shaft being fixed to its support block while disposed in its cylindrical opening.

8. An air damper as set forth in claim 7 in which each cylindrical opening and each shaft is of right circular cylindrical outline.

9. An air damper as set forth in claim 7 in which said bearing means comprises an antifriction bearing for each shaft.

10. An air damper as set forth in claim 7 in which said bearing means comprises a pair of spaced apart antifriction bearings for each shaft.

11. An air damper as set forth in claim 10 in which said operating means comprises a lever fixed to one of said shafts.

12. In an air damper comprising; a housing structure; a plurality of opposed blades each having rotatable shaft means and flow control plates; said blades having means supporting said shaft means on said housing structure enabling said control plates to be disposed in aligned relation to define a substantially planar shut-off structure for said damper and to regulate air flow therethrough; the improvement wherein said means supporting said shaft means comprises bearing means supporting said shaft means of one blade on one side of said planar structure and the shaft means of an immediately adjacent blade on the opposite side of said planar structure; said blades consisting of a plurality of alternate blades with their shafts means disposed in a plane upstream of said planar structure, and a plurality of alternate blades with their shaft means disposed in a plane downstream of said planar structure, said plane upstream of said planar structure being defined by the axes of associated shaft means and bearing means, said plane downstream of said planar structure being defined by the axes of associated shaft means and bearing means, whereby said blades are mounted in two sets; a linkage system for operating said shaft means; and operating means for operating said shaft means and said linkage system; said bearing means, blades, and linkage system being constructed and arranged so that upon operation of said operating means the rotational displacement of each blade from any reference position is approximately the same and the air flow distribution throughout the flow area of said damper is substantially uniform; said linkage system comprising an arm fixed to each shaft means at the same side of each blade, said arms being of equal length and with said blades disposed in said aligned relation and defining said planar shut-off structure the arm of one blade extends from its shaft means generally in one direction toward said planar shut-off structure and the arm of an immediately adjacent blade extends from its shaft means in a direction roughly opposite from said one direction toward said planar shut-off structure, and a plurality of links connected between said arms, each of said links extending between the terminal outer ends of each pair of immediately adjacent arms.

13. An air damper as set forth in claim 12 in which each of said blades is comprised of a pair of parallel plates each of rectangular outline and wherein one of said plates defines said flow control plate of the blade and the other of the plates has an area smaller than the area of the flow control plate and is disposed in spaced parallel relation therefrom.

14. An air damper as set forth in claim 13 and further comprising a plurality of sheet-like webs having opposite end edges fixed to and holding said plates in said spaced parallel relation.

15. An air damper as set forth in claim 14 in which each of said webs is of substantially trapezoidal outline and wherein the parallel end edge thereof having the longer dimension is fixed to said control plate.

16. An air damper as set forth in claim 13 in which said shaft means comprises a pair of shafts associated with each blade and fixed in rectilinearly aligned relation at opposite ends of the blade.

17. An air damper as set forth in claim 16 and further comprising a support block supporting each shaft, each support block being fixed between its associated plates.

18. In a method of making an air damper comprising the steps of; constructing a housing structure; mounting a plurality of opposed blades in said housing structure with each blade having rotatable shaft means and flow control plates; supporting said blades with means supporting said shaft means on said housing structure enabling said control plates to be disposed in aligned relation to define a substantially planar shut-off structure for said damper and to regulate air flow therethrough; the improvement wherein said supporting step comprises supporting said shaft means with bearing means supporting said shaft means of one blade on one side of said planar structure and the shaft means of an immediately adjacent blade on the opposite side of said planar structure; providing a linkage system for operating said shaft means; and connecting operating means to said shaft means for operating said shaft means and said linkage system; said bearing means, blades, and linkage system being constructed and arranged so that upon operation of said operating means the rotational displacement of each blade from any reference position is approximately the same and the air flow distribution throughout the flow area of said damper is substantially uniform; said step of providing a linkage system comprises the step of fixing an arm to each shaft means at the same side of each blade, said arms being of equal length and with said blades disposed in said aligned relation and defining said planar shut-off structure said steps of fixing an arm to each shaft comprises extending an arm of one blade from its shaft means generally in one direction toward said planar shut-off structure and extending the arm of an immediately adjacent blade from its shaft means in a direction roughly opposite from said one direction toward said planar shut-off structure, and connecting a plurality of links between said arms with each of said links being connected between the terminal outer ends of each pair of immediately adjacent arms.

19. A method as set forth in claim 18 in which each of said blades is comprised of a pair of parallel plates each of rectangular outline and wherein one of said plates defines said flow control plate of the blade and the other of the plates has an area smaller than the area of the flow control plate and is disposed in spaced parallel relation therefrom and comprising the further step of fixing said plates together in spaced parallel relation with a plurality of spaced sheet-like webs.

* * * * *